US007934332B2

(12) United States Patent
Briggs

(10) Patent No.: US 7,934,332 B2
(45) Date of Patent: May 3, 2011

(54) COMPOSITE FIREARM BARREL

(75) Inventor: Vernon R. Briggs, Sunapee, NH (US)

(73) Assignee: Sturm, Ruger & Company, Inc., Southport, CT (US)

( * ) Notice: Subject to any disclaimer, the term of this patent is extended or adjusted under 35 U.S.C. 154(b) by 879 days.

(21) Appl. No.: 11/360,197

(22) Filed: Feb. 23, 2006

(65) Prior Publication Data

US 2007/0193102 A1 Aug. 23, 2007

(51) Int. Cl.
*F41A 21/00* (2006.01)

(52) U.S. Cl. ..... 42/76.02; 42/76.1; 42/78; 89/14.05; 89/14.7; 29/520

(58) Field of Classification Search ..... 42/76.01, 42/76.02, 78, 76.1; 89/14.05, 16, 14.07; 29/520

See application file for complete search history.

(56) References Cited

U.S. PATENT DOCUMENTS 1,441,459 A * 1/1923 Small ..... 138/151
2,137,259 A * 11/1938 Boak ..... 42/76.02
2,371,125 A 3/1945 Bannister
2,609,631 A 9/1952 Garand
2,780,019 A 2/1957 Sullivan ..... 42/76
2,975,677 A * 3/1961 Kelly, Jr. ..... 89/16
2,981,155 A 4/1961 Parlanti ..... 89/16
3,118,243 A 1/1964 Manshel
3,125,806 A * 3/1964 Cameron ..... 29/520
3,177,688 A 4/1965 Kralowetz ..... 72/21
3,376,624 A 4/1968 Eves
3,442,172 A * 5/1969 Lorenz et al. ..... 89/16
4,176,487 A * 12/1979 Manis ..... 42/76.01
4,622,080 A * 11/1986 Wegwerth ..... 148/211
4,669,212 A 6/1987 Jackson et al. ..... 42/76.02
4,911,060 A 3/1990 Greenspan et al.
5,448,848 A 9/1995 Moller ..... 42/77
5,544,406 A * 8/1996 Ridenour et al. ..... 29/520

(Continued)

OTHER PUBLICATIONS

Briggs Vern et al., "Hammer Forged Barrels", Precision Shooting Magazine—Nov. 2005 (vol. 53-No. 7), pp. 1 of 13 at http:technology.calumet.purdue.edu/met/highley/Precision%20Shooting%20Magazine%2...Apr. 13, 2010.

(Continued)

*Primary Examiner* — Michelle Clement
(74) *Attorney, Agent, or Firm* — Duane Morris LLP; Frank J. Spanitz

(57) ABSTRACT

A composite barrel for a firearm and method for forming by forging. The barrel includes at least two materials joined together by forging. In a preferred embodiment, at least one material is preferably lighter in weight than the other material. The barrel may include an inner tube and an outer sleeve. The inner tube defines a bore that provides a bullet path and in one embodiment may be made of steel or alloys thereof. The outer sleeve surrounds the inner tube and in some embodiments may be made of aluminum, titanium, or alloys of either thereof. The tube preferably includes an exterior surface containing recessed areas therein for receiving material displaced from the outer sleeve by the forging process. The preferred barrel forming method generally may include inserting the tube into the sleeve, striking an outer surface of the sleeve, and deforming the sleeve to force material to flow into the recessed exterior surface of the tube to bond the tube and sleeve together. The method of forming may be used to produce long and short barrels for rifles and handguns respectively, and more broadly to produce other composite components unrelated to firearms.

37 Claims, 5 Drawing Sheets

U.S. PATENT DOCUMENTS

| | | | | |
|---|---|---|---|---|
| 5,856,631 | A * | 1/1999 | Julien | 89/16 |
| 5,928,799 | A * | 7/1999 | Sherman et al. | 428/655 |
| 6,230,429 | B1 | 5/2001 | Smith | 42/76.02 |
| 6,497,065 | B1 | 12/2002 | Huston | 42/76.02 |
| 6,564,689 | B1 | 5/2003 | Billgren | |
| 6,594,936 | B1 | 7/2003 | Sniezak et al. | |
| 6,691,397 | B2 * | 2/2004 | Chakravarti | 29/527.1 |
| 6,758,004 | B2 | 7/2004 | Huston | |
| 6,857,558 | B2 * | 2/2005 | Ferry et al. | 228/190 |
| 2004/0149000 | A1 * | 8/2004 | Stupecky | 72/416 |
| 2004/0216350 | A1 | 11/2004 | Huston | 42/76.1 |
| 2007/0164086 | A1 * | 7/2007 | Hochhalter et al. | 228/112.1 |
| 2007/0261286 | A1 * | 11/2007 | Briggs | 42/76.02 |

OTHER PUBLICATIONS

Corresponding Korean patent Application No. 10-2008-7023157 Office Action of Oct. 26, 2010.

Corresponding European Application No. 07867001.5—1260/1994356 PCT/US2007004688 extended European search report Aug. 6, 2010 (7 pages).

* cited by examiner

FIG. 8
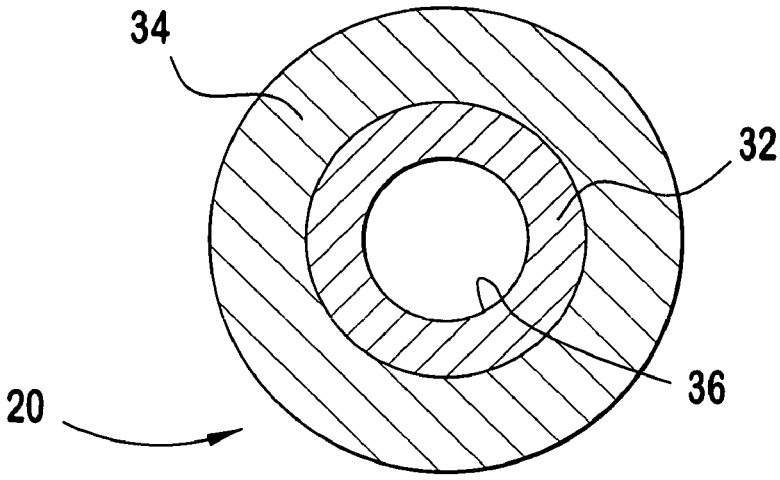
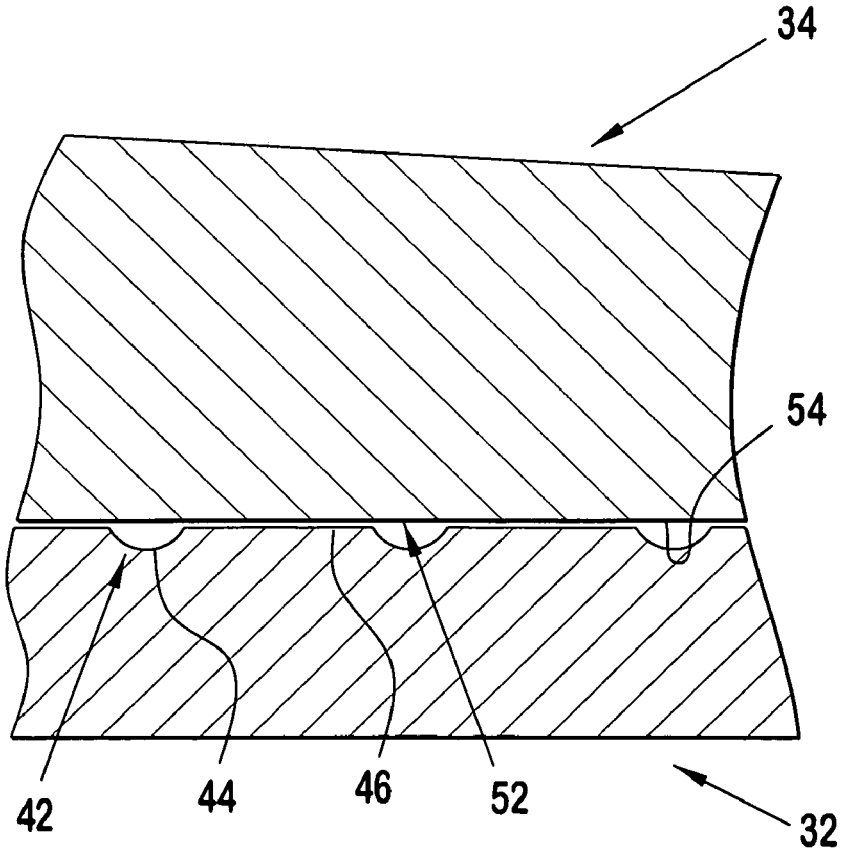
FIG. 9

COMPOSITE FIREARM BARREL

BACKGROUND OF THE INVENTION

The present invention generally relates to firearms, and more particularly to an improved composite firearm barrel.

The barrel of a firearm is in essence a pressure vessel that is subjected to heat and forces of combustion generated by igniting a cartridge powder charge when the firearm is discharged. Accordingly, steel has been the material of choice for firearm barrels because its mechanical properties allow it to repeatedly withstand numerous cycles of discharging the firearm. But barrels made of entirely steel tend to be heavy, which may make steel-barreled firearms cumbersome to carry for long periods of time or to hold steady during shooting competitions. One attempted solution to produce lighter barrels has been to use aluminum barrels provided with hard-coated or plated bore surfaces for the bullet path. These barrels may be expensive to manufacture and the thinly coated bores surfaces may wear away over time. Composite firearm barrels, defined herein as barrels made of two or more different components, are also known. Some of these barrels include steel inner tubes with outer sleeves or shells made of lighter-weight material, such as aluminum or synthetic plastic resins. Joining the multiple components together to form a secure bond capable of withstanding repeated firearm discharges, however, has been problematic. The outer sleeves have sometimes been attached to the inner steel tubes with adhesives, press-fitting, screwed or threaded connections, sweating or brazing, and by casting. These production techniques may result in composite barrels that may separate over repeated cycles of discharging a firearm due to inadequate bonding or coupling between the inner tubes and outer sleeves or shells. Some known designs may also require multiple fabrication steps and be labor intensive to produce, thereby sometimes making manufacture of these conventional composite barrels complicated and expensive.

Accordingly, there is a need for a light-weight composite barrel that is simple and economical to manufacture, and yet provides a strong and permanent bond between the inner and outer components.

SUMMARY OF THE INVENTION

An improved composite barrel and novel method for forming the same is provided that overcomes the foregoing shortcomings of known composite barrels. In a preferred embodiment, a composite barrel according to principles of the present invention is made by forging which provides a superior and strong bond between the different barrel components in contrast to the foregoing known fabrication techniques. The novel use of the forging method described herein integrates well with existing fabrication processes normally employed in a firearms factory to produce barrels. Therefore, additional and/or more complex fabrication steps and equipment are avoided which advantageously results in efficient and economical manufacturing in contrast to known methods. A composite barrel and method of manufacture as described herein may be utilized for both long barrel rifles and short barrel pistols, with equal advantage in either application.

In one exemplary embodiment, a composite barrel according to principles of the present invention may include an inner tube having a longitudinally-extending bore and a first density, and an outer sleeve having a second density less than the first density of the inner tube, wherein the sleeve is forged to the inner tube. The inner tube may include a plurality of recessed areas on an exterior surface for receiving material displaced from the outer sleeve by forging to bond the tube and sleeve together. In one embodiment, the recessed areas may be in the form of ridges defining grooves both of which extend helically around at least part of the exterior surface and length of the inner tube. In some embodiments, the inner tube is preferably made of steel or steel-alloy and the outer sleeve is preferably is made of a material selected from the group consisting of aluminum, aluminum-alloy, titanium, and titanium-alloy.

In another embodiment, a composite barrel may include an inner tube defining a central bore and including an outer surface having a plurality of recessed areas, and an outer sleeve defining a passageway and including an inner surface. The inner tube preferably is received at least partially in the outer sleeve. The sleeve has a first configuration prior to forging and a second configuration after forging, the first configuration different than the second configuration. In one embodiment, the inner surface of the sleeve has a substantially smooth surface in the first configuration and has a plurality of raised areas in the second configuration. In another embodiment, at least some of the raised areas are received in recessed areas of the inner tube to bond the inner tube and outer sleeve together. The recessed areas of the inner tube are preferably disposed in an exterior surface of the inner tube and in one embodiment may extend circumferentially around at least a portion of the exterior surface. In one exemplary embodiment, the recessed areas of the inner tube are shaped as helical grooves extending at least partially along a length of the tube. In another embodiment, the recessed areas may be in the form of a knurled surface on at least a portion of the outer surface of the inner tube.

In another embodiment, a composite barrel may include an inner tube defining a central bore and including an outer surface having a plurality of recessed areas, the inner tube having a first density, and an outer sleeve defining a passageway and the inner tube received at least partially therein, the sleeve having a second density less than the first density of the inner tube. The sleeve has a first diameter prior to forging and a second diameter after forging, the first diameter larger than the second diameter. The sleeve also has a first length prior to forging and a second length after forging, the second length being longer than the first length.

A method of forming a composite firearm barrel may include: providing an inner tube having a first density; providing an outer sleeve having a second density less than the first density; inserting the inner tube at least partially into the outer tube; impacting forcibly the sleeve in a radially inward direction; and displacing a portion of the outer sleeve to engage the inner tube, wherein the sleeve is bonded to the inner tube to form a composite firearm barrel. In one embodiment, the barrel is formed by forging with a hammer forge.

In another embodiment, a method of forming a composite firearm barrel may include: providing a tube-sleeve assembly including an outer sleeve and an inner tube disposed at least partially therein, the sleeve having inner and outer surfaces, the inner tube having an exterior surface; striking radially the outer surface of the sleeve; and embedding at least a portion of the exterior surface of the inner tube into the inner surface of the sleeve to bond the sleeve to the inner tube.

A method of forming a composite article may include: providing a tube-sleeve assembly including an outer sleeve and an inner tube disposed at least partially therein, the sleeve having inner and outer surfaces, the inner tube having an exterior surface; and forging the tube-sleeve assembly to bond the outer sleeve to the inner tube. In one embodiment, the forging step includes hammering the outer surface of the sleeve in a generally radially inward direction. In one embodiment, the tube is made of steel or steel-alloy and the sleeve is made of a metal selected from the group consisting of aluminum, aluminum-alloy, titanium, and titanium-alloy. In one embodiment, the tube is made of metal having a first density and the sleeve is made of metal having a second density, the first density being different than the second density. Preferably, the second density is less than the first density in a preferred embodiment. The method may further include the step of rotating the tube-sleeve assembly during the forging step. In one embodiment, the tube-sleeve assembly is a firearm barrel.

As used herein, any reference to either orientation or direction is intended primarily for the convenience in describing the preferred embodiment and is not intended in any way to limit the scope of the present invention thereto.

BRIEF DESCRIPTION OF THE DRAWINGS

The features of the preferred embodiments will be described with reference to the following drawings where like elements are labeled similarly, and in which:

FIG. 8 is a cross-section taken through the finished barrel of FIG. 1; and FIG. 9 is a partial longitudinal cross-section through the barrel of FIG. 1 prior to forging and showing the inner tube inserted in the outer sleeve.

DESCRIPTION OF THE PREFERRED EMBODIMENTS

In order that the invention may be understood, a preferred embodiment, which is given by way of example only, will now be described with reference to the drawings. The preferred embodiment is described for convenience with reference and without limitation to a firearm barrel for a rifle. However, the principles disclosed herein may be used with equal advantage for a pistol or handgun. According, the invention is not limited in this respect. Moreover, the process for manufacturing composite material parts described herein may equally be employed for making light-weight components other than firearm barrels where weight and manufacturing savings are advantageous, such as in the aerospace industry. Accordingly, the preferred process described herein to make composite articles is not limited to firearm barrel production alone.

Figure 1:
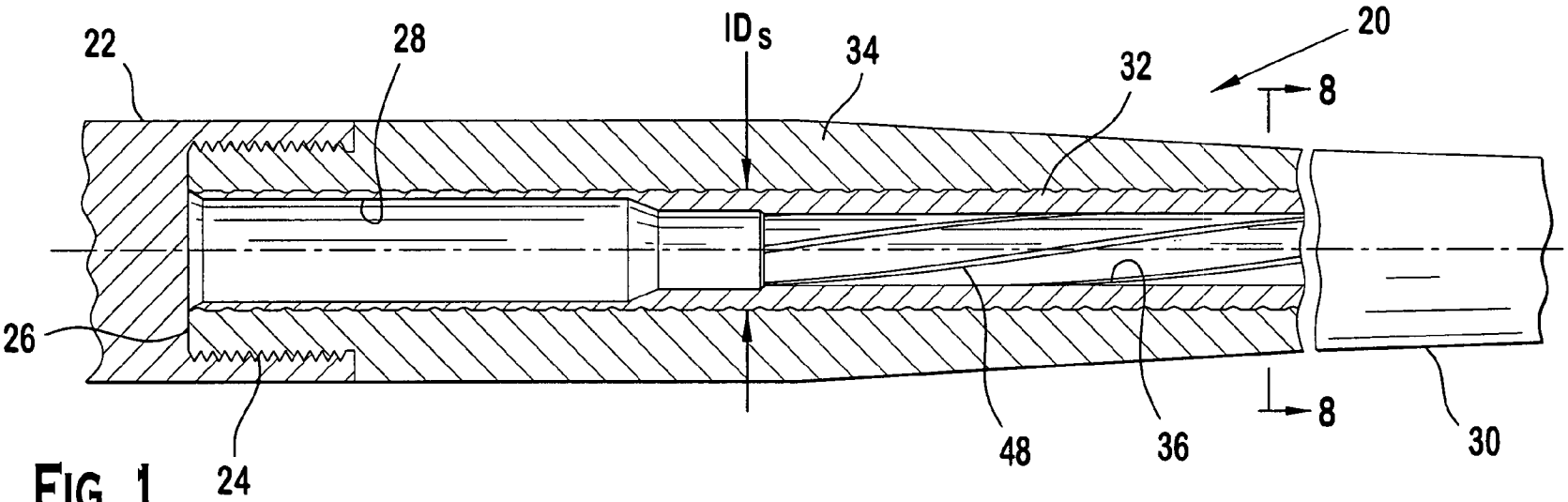
FIG. 1 is a longitudinal cross-section taken through a preferred embodiment of a composite firearm barrel produced in accordance with a preferred method of production described herein, and showing the outer sleeve and inner tube.

Referring now to FIG. 1 which shows a cross-section of a portion of a firearm, a firearm formed according to principles of the present invention in a preferred embodiment generally includes a barrel 20 which may be connected to a receiver 22 via a threaded connection 24, as shown. Barrel 20 defines an internal bore 36 which provides a path through which a bullet propelled from a discharged cartridge may travel, a chamber 28 at one end for receiving and holding the cartridge, and a muzzle 30 at a second opposite end from which the bullet ultimately exits the firearm. Bore 36 communicates with chamber 28 and extends through the longitudinal centerline of barrel 20 from chamber 28 through muzzle 30, as shown. Bore 36 defines a longitudinal axis of barrel 20. As shown in FIG. 1, chamber 28 is preferably configured and adapted to compliment the shape of the cartridge. As conventionally practiced in the art, rifling 48 is preferably provided on the surface of bore 36 to impart spin to an exiting bullet for improving accuracy. Rifling 48 may be described as a shallow spiral groove which may be cut or formed in the wall of the bore 36.

Barrel 20 preferably is a composite structure formed from different materials to permit a reduction in total barrel weight to be realized. In the preferred embodiment shown, barrel 20 includes an inner tube 32 and an outer sleeve 34 attached to the inner tube. Preferably, inner tube 32 is made from a metal or metal alloy having sufficient strength and ductility to withstand the heat and pressure forces of combustion created when a cartridge is discharged, such as steel or steel alloy. In some embodiments, inner tube 32 may be made of stainless steel or chrome-moly steel. The tube may be made by drilling roundstock, casting, extrusion, or any other processes conventionally used in the art. Inner tube 32 functions as a liner for outer sleeve 34.

Figure 4:
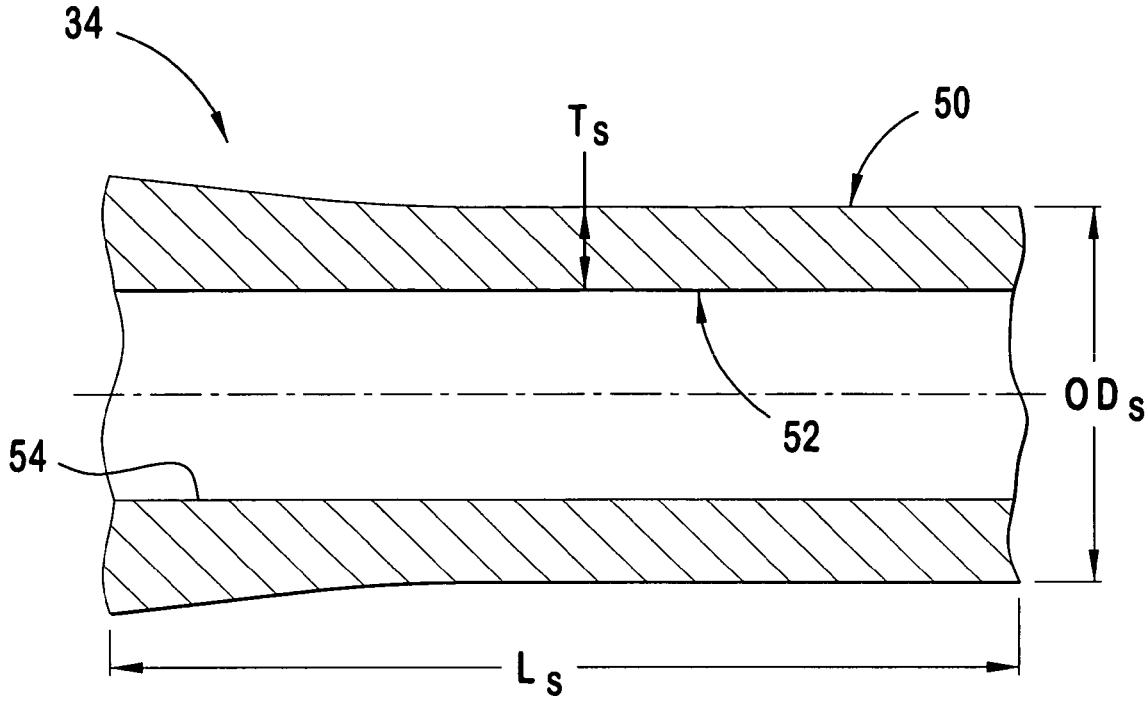
FIG. 4 is a longitudinal cross-section of a portion of the outer sleeve of the barrel of FIG. 1.

Outer sleeve 34 is preferably made of a malleable metal or metal alloy having a weight and density less than the weight and density of inner tube 32 to reduce the combined total weight of barrel 20. Referring also to FIG. 4, sleeve 34 is also preferably in the form of a tube similar to inner tube 32 and has an outside diameter ODs. In a preferred embodiment, outer sleeve 34 is made of aluminum or titanium, or alloys of either aluminum or titanium. Some preferred exemplary aluminums are types T651 and T6511. One preferred exemplary titanium alloy is Ti-6Al-4V. It should be noted that other light-weight metals (e.g., magnesium or magnesium alloys, etc.) are contemplated and may be used so long as the sleeve material has a weight and density less than that of the inner liner tube 32, and are sufficiently malleable for forging and bonding to the inner tube.

A typical representative range of densities for steel or steel alloy which may be used in some embodiments for inner tube 32 is about 7.5-8.1 grams/cubic centimeter, without limitation, depending on the type of steel used and any alloying element content. A typical range for aluminum or aluminum alloy would be about 2.7-2.8 grams/cubic centimeter without limitation. A typical range for titanium or titanium alloy would be about 4.4-4.6 grams/cubic centimeter without limitation. Accordingly, it will be apparent that substituting lower density and concomitantly lighter weight aluminum or titanium for steel to make at least part of the barrel will result in a reduction in weight.

The composite barrel components of the preferred embodiment will now be described in more detail, followed by a description of the preferred method or process of forming the composite barrel.

Figure 2:
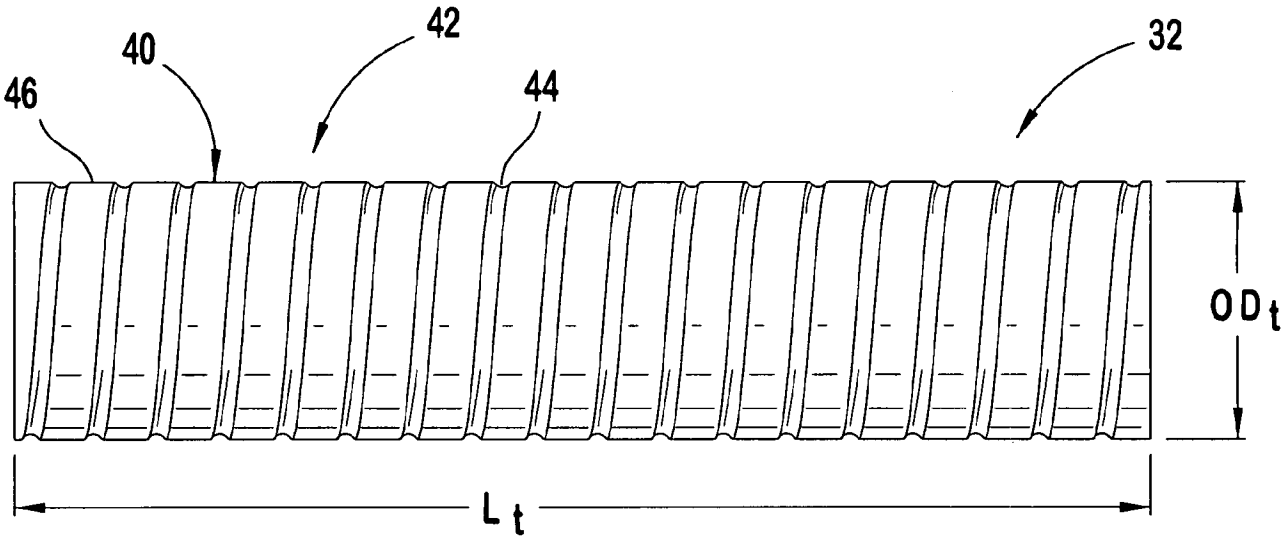
FIG. 2 is a side view of the inner tube of the barrel of FIG. 1 showing one embodiment of a possible exterior surface structure of the tube.

Referring to FIG. 2, inner tube 32 has an exterior surface 40 which preferably is configured to receive material forcibly displaced and protruded from the outer sleeve 34 resulting from the forging process. Preferably, an exterior surface 40 structure including recessed areas such as depressions or cavities are provided therein for that purpose. Accordingly, surface 40 in a preferred embodiment has a combination of raised surface areas and recessed surface areas that function to lockingly engage and secure outer sleeve 34 to inner tube 32, thereby resisting relative longitudinal axial movement between the sleeve and tube when joined or bonded together.

In one embodiment as shown, the exterior surface structure of inner tube 32 may be in the form of helical threading 42 formed on exterior surface 40 of inner tube 32. Threading 42 may include raised helical ridges 46 and lowered helical grooves 44 disposed between successive convolutions of the ridges. The top of ridges 46 define a major diameter for threading 42 and the bottom of grooves 44 define a threading root diameter. Ridges 46 preferably project radially outwards from and above the root diameter of exterior tube surface 40. Ridges 46 preferably may be produced by conventional methods such as cutting grooves 44 into exterior surface 40 of inner tube 32. In other embodiments, the ridges and grooves may be cast into inner tube 32 if the tube is made by casting. Ridges 46 preferably have top surfaces that are shaped to be substantially flat in one embodiment; however, other top shapes such as arcuate, pointed, etc. may be used. The axial side wall surfaces of ridges 46, which also form the walls of grooves 44, may be straight, arcuate, angled, or another shape. Preferably, ridges 46 may have an axial longitudinal width equal to or greater than the axial longitudinal width of grooves 44. Grooves 44 also preferably may have substantially flat, arcuate, or sharply angled bottom surfaces. In one possible embodiment by way of example only, ridges 46 may have a typical width of about 0.09 inches and grooves 44 may have a typical width of about 0.03 inches. However, other widths for ridges 46 and grooves 44 may be provided. Threading 42 may preferably have a typical pitch in some embodiments of about 8 threads/inch to 20 threads/inch, and more preferably about 10 threads/inch to 16 threads/inch.

In contrast to conventional finer screw or machine-type threading characterized by tightly spaced, sharply angled peaks and grooves, the foregoing preferred threading with relatively wide and flat-topped ridges 46 (and widely spaced apart grooves 44) advantageously help the threading resist being completely flattened or squashed in the forging process so that displaced material from outer sleeve 34 may be forced substantially uniformly and deeply into grooves 44 to provide a tight bond between the sleeve and inner tube 32. Producing the preferred threading with wider spaced grooves 44 also advantageously reduces manufacturing time and costs to cut the threads than if conventional threaded were used with tightly spaced peaks and grooves.

Although a preferred threaded exterior surface 40 structure of inner tube 32 is described above, other suitable configurations are contemplated and may be used. For example, conventional threading having sharply angled thread ridges or peaks and V-shaped valleys therebetween may be used (not shown) so long as a groove depth is provided that receives displaced material from outer sleeve 34 by forging sufficient to provide a secure and locking relationship between the sleeve and inner tube 32. Various threading configurations known in the art may be used such as acme, worm, ball, trapezoidal, and others.

Figure 5:
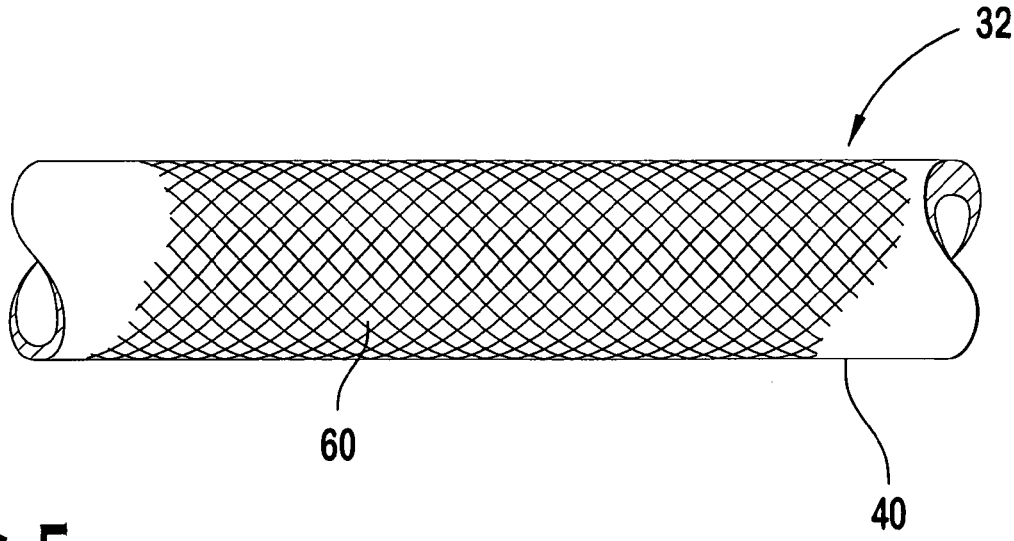
FIG. 5 is a side view of the inner tube of the barrel of FIG. 1 showing another possible embodiment of an exterior surface structure of the tube.

It will be appreciated that the exterior surface 40 may assume numerous other forms or shapes rather than threading so long as recesses or depressions of sufficient depth are provided in exterior surface 40 of inner steel tube 32 to receive deformed material from outer sleeve 34 produced by the forging process. In one alternative embodiment, exterior surface 40 of tube 32 may have a plurality of spaced-apart circumferential grooves 44 shaped similarly to those shown in FIG. 2, but which are not helical and are oriented substantially perpendicular (not shown) to the longitudinal axis of tube 32. In another possible embodiment shown in FIG. 5, recessed areas in the form of knurling 60 may provided on exterior surface 40 in lieu of threading. Furthermore, the exterior surface 40 structure need not be uniform in design or pattern as shown herein, and the recessed areas may be comprised of non-uniform or irregularly shaped random patterns, geometric shapes, or other configurations. This may include simply a sufficiently roughened or pitted exterior surface 40 of inner tube 32 that provide cavities of sufficient depth to longitudinally lock outer sleeve 34 to the tube by forging. In another possible embodiment, although not a preferred embodiment, exterior surface 40 of tube 32 and inner surface 52 of sleeve 34 may be relatively smooth prior to being forged together. It should also be noted that only a portion of exterior surface 40 of tube 32 may be contain recessed areas in other possible embodiments. Therefore, the recessed areas need not be provided along the entire length of inner tube 32 or may be provided in spaced-apart patterns or grouping along the length of the tube. Accordingly, it will be apparent that the invention is not limited to the few examples of possible recessed surface configurations disclosed herein.

Exterior tube threading 42 may preferably, but need not necessarily, be directionally oriented in an opposite direction than rifling 48 in bore 36 (see FIG. 1) which is cut or formed into barrel 20. For example, in a preferred embodiment, threading 42 is left-handed and rifling 48 is right-handed. In other embodiments, threading 42 may be right-handed while rifling 48 is left-handed. During the process of making composite barrel 20 as described in detail below, the use of opposite hand threading for exterior threading 42 and rifling 48 provides added assurance that the attachment of outer sleeve 34 to inner tube 32 is not loosened when the rifling is added to the barrel. In fact, using opposite hand threading would advantageously tend to tighten the connection between outer sleeve 34 and inner tube 32. Alternatively, it will be appreciated exterior tube threading 42 and rifling 48 may have the same hand or directional threading in some embodiments if desired because the bond between outer sleeve 34 and inner tube 32 is primarily formed by forging and material deformation, rather than by a threaded connection alone.

Figure 3:
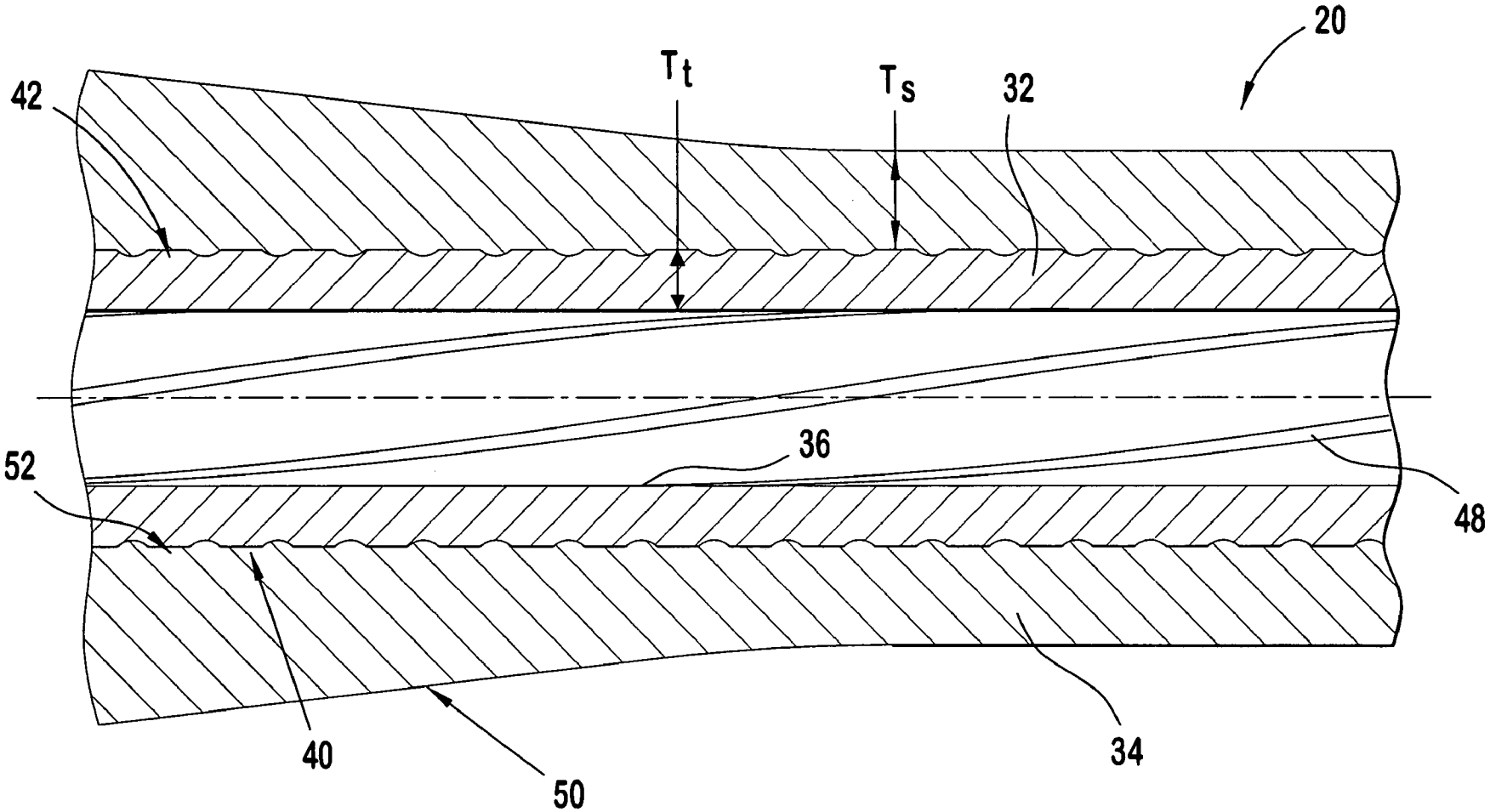
FIG. 3 is a detail view of a portion of the barrel cross-section of FIG. 1.

Referring to FIG. 3, which shows a cross-section through a completed composite barrel formed according to a preferred embodiment, inner tube 32 preferably has a wall thickness Tt that on one hand is sufficient to accommodate cutting rifling 48 therein and to retain suitable strength to absorb the forces associated with discharging a cartridge, while on the other hand is small enough so as to not add undue weight to barrel 20. Outer sleeve 34 preferably has a wall thickness sufficient to make up the desired outside diameter of barrel 20 and to provide any additional strength to the composite barrel that may be required. It will be appreciated that the inner tube 32 and sleeve 34 thicknesses will vary with the size and type of firearm being manufactured and ammunition used, and materials selected for the inner tube and sleeve. Determination of appropriate thicknesses for the desired application and materials are readily within the abilities of those skilled in the art.

The preferred method or process of making a composite barrel according to principles of the present invention will now be described with reference to FIGS. 1-3. Composite barrel 20 is preferably formed by forging, and more preferably by hammer forging using a commercially-available hammer forging machine such as those built by Gesellschaft Fur Fertigungstechnik und Maschinenbau (GFM) in Steyr, Austria. In general, hammer forges conventionally have been used to manufacture one-piece steel barrels in the firearms industry. The conventional process begins with a bored barrel blank that is typically shorter than the desired finished barrel. A mandrel (not shown), which may include the rifling in raised relief on it, is inserted down through the blank in the bore. Since the mandrel essentially sets the minimum final bore diameter of the barrel after forging, the diameter of the mandrel is selected in part based on the desired final bore diameter. The blank is then progressively fed through the machine and hammered around the mandrel by opposing hammers in a process known as rotary forging. This process thins and elongates the barrel to produce a barrel having a finished length and outside diameter longer and smaller than the blank used to begin the process. The rifling is concurrently produced in the barrel bore at the same time. Alternatively, the rifling may be cut into the barrel bore in a separate operation. This same forging machine may be used to produce composite barrels using the method described herein which heretofore has not been used for that purpose. Accordingly, new and additional pieces of machinery for the firearm factory are not required to produce composite barrels according to the principles of the invention which eliminates additional capital expenditures and maintenance/operating costs.

The preferred method of making a composite barrel begins by providing steel barrel blank which may be in the form of round stock. Internal bore 36 may then be formed in the barrel blank by drilling to create the hollow structure of inner steel tube 32 which has an initially plain exterior surface 40. Exterior threading 42 is next cut into exterior surface 40 of tube 32 to provide surface recesses in the form of grooves 44 configured for receiving deformed material of outer sleeve 34 that is displaced from the forging process. Alternatively, however, it will be appreciated that the process may begin by procuring and providing pre-fabricated inner steel tube 32, with either a plain exterior surface 40 or including exterior threading 42. If a plain exterior surface 40 is provided, exterior threading 42 must be cut into the surface.

Outer shell or sleeve 34 is also provided, which preferably is in the form of a tube having an outer surface 50 and passageway 54 defining an inner surface 52 (see FIG. 4). Inner surface 52 preferably may be smooth or slightly roughened since the material is intended to be deformed and forced into the inner tube 32 by forging. Therefore, the inner surface finish is not important so long as the sleeve material may be forced into the recessed areas of the tube exterior surface 40 by the forging process. Preferably, however, inner surface 52 does not have a surface configured with recesses or sunken areas that may interfere with material from sleeve 34 from being relatively uniformly forced into the grooves 44 of inner tube 32 by forging. Outer sleeve 34 preferably has a substantially uniform wall thickness Ts. Outer sleeve 34 may be produced in the same general manner described above for inner tube 32, or by extrusion or other techniques commonly used in the art of metal component fabrication. In a preferred embodiment, outer sleeve 34 is preferably made of aluminum, titanium, or alloys of either aluminum or titanium; however, other suitable light-weight metals or metal alloys may be used provided they have sufficient malleability to undergo deformation during the forging process to fill grooves 44 in inner tube 32 (see FIG. 2).

The barrel forming process continues by inserting inner tube 32 into outer sleeve 34. This places the inner surface 52 of outer sleeve 34 proximate to exterior surface 40 of inner tube 32, but not necessarily contacting the inner tube at all places along the length and circumference of the sleeve and inner tube. The outside diameter $OD_T$ of inner steel liner tube 32 (FIG. 2) is preferably slightly smaller than the inside diameter $ID_S$ of outer sleeve 34 (FIG. 1) so that the tube may slide into the outer sleeve. A relatively close fit and somewhat tight dimensional tolerances between inner tube 32 and outer sleeve 34 before forging is preferred, but not essential, so long as outer sleeve 34 is proximate to and may be forced thoroughly into grooves 44 of steel tube 32 to produce a secure bond during the hammer forging process.

It will be noted that tube-sleeve assembly 32, 34 has a first initial or prefabrication configuration and size prior to forging. Referring to FIGS. 4 and 9 showing sleeve 34 (the latter which shows a partial cross section through a portion of inner tube 32 inserted inside outer sleeve 34 before forging), outer sleeve inner surface 52 of sleeve passageway 54 preferably is relatively uniform and smooth without any substantial surface structures protruding radially therefrom or recessed therein that might interfere with forming a good bond between the tube and outer sleeve by forging. Inner tube 32 in a preferred embodiment may be as shown in FIG. 2 with exterior threading 42 and a relatively smooth bore 36 (not shown).

Figure 6:
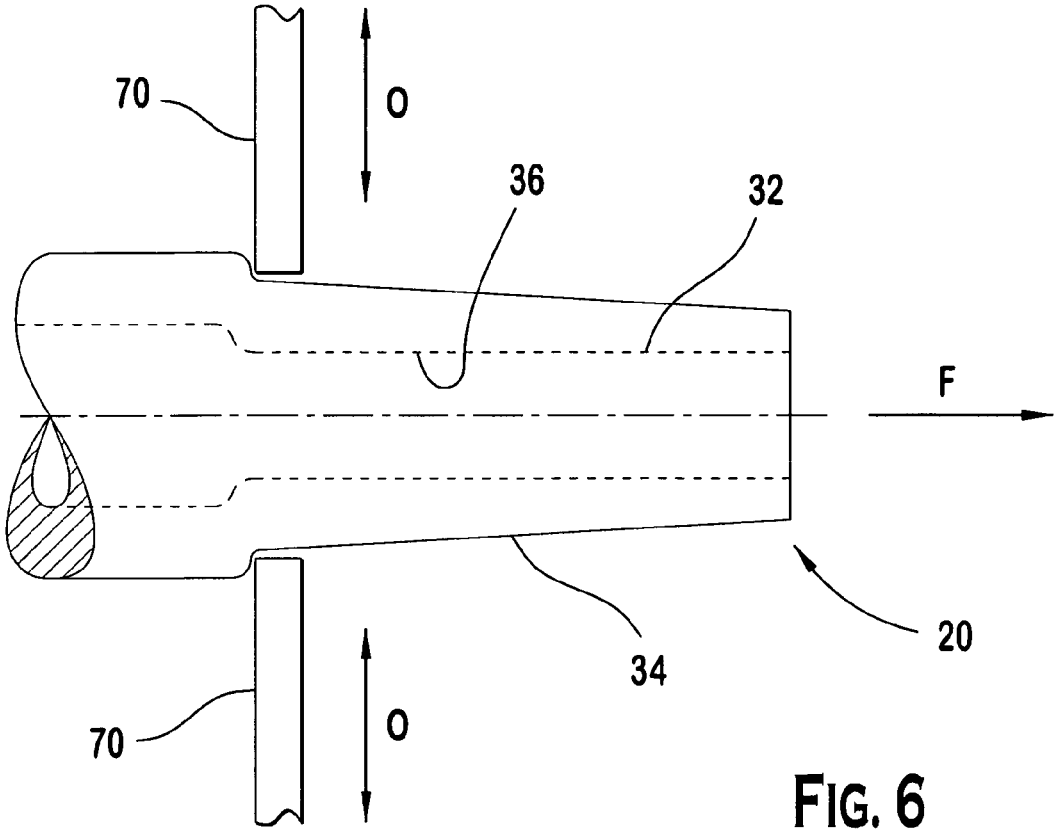
FIG. 6 is a side view of the barrel of FIG. 1 showing its progression from original pre-forged form to final post-forged form as it is fed through the preferred fabrication process using a hammer forging machine.

Referring to FIG. 6, the tube-sleeve assembly 32, 34 is next loaded into the hammer forging machine. A hammer forge mandrel (not shown) is inserted through bore 36 of tube 32, and the tube-sleeve assembly 32, 34 with mandrel inserted therein is advanced in an axial direction F into the forging machine. Both the mandrel and tube-sleeve assembly 32, 34 are simultaneously rotated by the forging machine while being moved axially forward in the machine. Tube-sleeve assembly 32, 34 continues to advance towards the forging section of the machine and through diametrically-opposed oscillating impact or striking members such as hammers 70 which strike and contact (i.e., "hammer") the outer surface of sleeve 34 with substantial force. This process is known also as rotary forging. Hammers 70 oscillate back and forth at an extremely high rate of speed in a direction O, which preferably is generally perpendicular to the workpiece surface such as outer surface 50 of sleeve 34.

In one embodiment, the forging machine may contain four hammers 70 (shown diagrammatically in FIG. 6 in side elevation view) with two-pairs each being diametrically-opposed by an angle of 180 degrees. In FIG. 6, the vertical pair of opposed hammers 70 are shown while the horizontal pair of hammers are omitted for clarity of depicting the tube-sleeve assembly 32, 34. The supporting structure for the hammers, other component details of the hammer forging machine, and operation thereof may be readily determined by those skilled in the art by reference to the forging machine manufacturer's operating and maintenance manuals. Accordingly, for the sake of brevity, these aspects of the forging machine and references are not duplicated herein. It will be noted that the axial feed rate and rotational speed (RPM) of the tube-sleeve assembly 32, 34 may be adjusted and optimized as required by the forging machine user based on the diameter of the assembly and wall thickness of the components to achieve a good bond between the tube and sleeve. This may easily be determined by those skilled in the art through routine trial runs with barrel materials with reference to the forging machine manufacturer's manuals.

Figure 7:
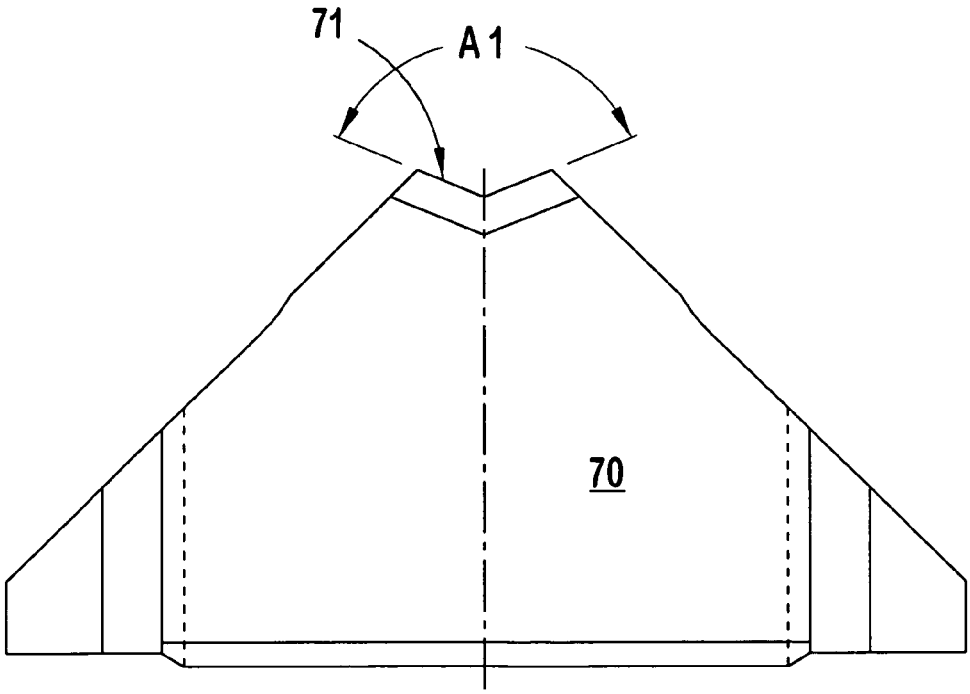
FIG. 7 is a front view of one of the forging hammers of FIG. 6.

FIG. 7 shows a front elevation view of a typical hammer from FIG. 6 (viewed axially along tube-sleeve assembly 32, 34 in feed direction F of the forging machine). Each hammer 70 may be generally triangular in shape in one embodiment and have a striking surface 71 which strikes and deforms the workpiece such as tube-sleeve assembly 32, 34. Striking surface 71 in some embodiments may be slightly radiused and/or angled forming a striking surface angle A1 as shown to compliment the generally round cross section of the workpiece. Angle A1 may typically be about 135 degrees to about 155 degrees in some embodiments, but may be smaller or larger than that range depending on the diameter of the tube-sleeve assembly 32, 34. Varying angle A1 can be used to produce differing types of aesthetic surface finishes from very smooth where the hammer marks on outer surface 50 of sleeve 34 may not be readily noticeable, to a rougher finish in which the hammer marks are intentionally noticeable. Accordingly, angle A1 is not limited to the foregoing range.

It should be noted that the invention is not limited by type of commercial forging machine used, the position or number of forging hammers used, or individual configuration or details of the hammers themselves. Any type of hammer forging machine or other suitable type of forging apparatus and operation can be used so long as the outer sleeve may be deformed and bonded to the inner tube in the same or equivalent manner described herein.

Referring again to FIG. 6, tube-sleeve assembly 32, 34 continues to be fed axially and advanced through the hammer forge. The impact hammers 70 strike outer surface 50 of sleeve 34 with tremendous force that progressively hammers the tube-sleeve assembly around the forging mandrel. Hammer 70 preferably strike sleeve 34 approximately perpendicular to outer surface 50 and in a radially inwards direction. This radially compresses and deforms sleeve 34 which is essentially squeezed between the mandrel and inner tube 32 on the inside, and the hammers 70 on the outside which circumferentially constrain the sleeve. The hammering causes material from inner surface 52 of the sleeve to be displaced and forced to flow into the cavities or recessed areas of the inner tube exterior surface 40, such as grooves 44. The displaced material from outer sleeve 34 becomes embedded in grooves 44 such that the sleeve engages the grooves of inner tube 32 to join the sleeve and tube together. Preferably, material from sleeve 34 fills at least part of the depth of grooves 44. More preferably, substantially the entire depth of grooves 44 are filled with embedded material from outer sleeve 34. The forging operation also causes material from sleeve 34 to flow in a longitudinal direction, which becomes longer in length after forging than before. Barrel 20 is essentially squeezed off the mandrel as it progresses through the oscillating hammers. It should be noted that alternatively, the forging operation may conversely be viewed from the perspective of the inner tube as depressing ridges 44 into inner surface 52 of the outer sleeve 34, thereby forming depressions in the sleeve corresponding to the ridges 44 of the tube.

As shown in FIG. 6, tube-sleeve assembly 32, 34 undergoes a physical transformation in terms of size during the forging process, thereby resulting in a second final size that is different than the assembly's first initial prefabrication size. Tube-sleeve assembly 32, 34 is generally reduced in diameter and longitudinally elongated or increased in length as the assembly moves through the hammers 70 and material is displaced. The combined tube-sleeve assembly may be elongated in length by about 15% or more. Accordingly, after forging, the final outside diameter ODs of outer sleeve 34 is smaller than the beginning outside diameter ODs. Sleeve wall thickness Ts also becomes smaller than its initial thickness. And sleeve length Ls (see FIG. 4) becomes longer after the forging process. Length Lt of inner tube 32 becomes longer than its first prefabrication length after forging. Outside diameter ODt and wall thickness Tt undergo a reduction in size and become smaller.

By way of example, in one trial production of a composite barrel for a 22 caliber rimfire rifle using a hammer forging machine, the following dimensional transformations resulted with a barrel having a steel inner tube 32 and titanium outer sleeve 34. Before forging, inner tube 32 had an initial ODt of 0.375 inches and an IDt of 0.245 inches. After forging, tube 32 had a final outstide diameter ODt of 0.325 inches and an IDt of 0.2175 inches (final IDt based on desired bore diameter and selection of suitable mandrel diameter necessary to produce the desired bore diameter). Accordingly, a reduction of approximately 13% in diameter resulted from forging based on the outside diameter ODt of tube 32. Concomitantly, this also resulted in a growth in length Lt of tube 32 by about 13% as tube material compressed and displaced by forging results in a longitudinal displacement of material and elongation of the tube. The mandrel and mechanical properties of the steel essentially limits in part the inwards radial displacement of tube material and reduction in diameter, which then forces material to be displaced in a longitudinal direction instead. It will be appreciated that a reduction in wall thickness Tt of tube 32 may concomitantly occur during the forging process (about 0.02 inches in the above example).

Before forging, outer sleeve 34 in the same 22 caliber rifle trial production had an initial ODs of 1.120 inches and an IDs of 0.378 inches. After forging, sleeve 34 had a final outside diameter ODs of 0.947 inches and an IDs of about 0.325 inches. Accordingly, a reduction of approximately 15% in diameter resulted from forging based on the outside diameter ODs of sleeve 34. Concomitantly, this also resulted in a growth in length Ls of sleeve 34 by about 15% as sleeve material compressed and displaced by forging results in a longitudinal displacement of material and elongation of the sleeve. Inner tube 32 and mechanical properties of the titanium essentially limits in part the maximum inwards radial displacement of sleeve material and reduction in diameter, which then forces material to be displaced in a longitudinal direction instead. It will be appreciated that a reduction in wall thickness Ts of sleeve 34 may concomitantly occur during the forging process (about 0.12 inches in the above example).

During the forging operation, in addition to the foregoing dimensional changes that occur, outer sleeve 34 also concomitantly undergoes a transformation in configuration or shape. After forging, inner surface 52 of sleeve 34 is reshaped being now characterized by a series of helical raised ridges and recessed grooves which are substantially a reverse image of the ridges 46 and grooves 44 of inner tube 32. This results from the deformation of outer sleeve 34 by forging which forces its material to flow into ridges 46 and grooves 44 of inner tube 32 to permanently bond the sleeve and tube together. Accordingly, in contrast to known composite barrel fabrication techniques used heretofore, the final reconfigured composite barrel according to principles of the present invention advantageously derives a strong and secure bond from this reshaping transformation. In addition, in contrast to barrel liners having cast-on sleeves, the forged composite barrel of the present invention has superior strength.

At the same time tube-sleeve assembly 32, 34 is forged, rifling 48 may optionally be hammered in bore 36 of inner tube 32 if a mandrel with rifling in raised relief as described above is provided. Alternatively, rifling may added to bore 36 by cutting or cold forming by pulling a rotating button with raised lands mounted on a long rod of a hydraulic ram through the barrel bore. After outer sleeve 34 has been bonded to inner tube 32, any final machining or finishing steps, such as grinding, polishing, machining a chamber in the barrel, etc. may then be completed to tube-sleeve assembly 32, 34 as required.

The forging process and resulting material deformation produces a strong and secure bond between tube 32 and outer tube 34 to the extent that the materials of the two components are virtually fused together into a single bi-metal component such that the interface between the inner tube and outer sleeve materials may become almost unperceivable. The reformed composite barrel thus avoids potential looseness between the joined barrel components which could otherwise vibrate and possibly separate after repeated cycles of discharging the firearm. It should be noted that the material from outer sleeve 34 need not be completely forced by forging into every portion of inner tube helical groove 44 so long as a sufficient circumferential and longitudinal extent of the groove is filled with sleeve material to provide a strong bond between the barrel components. Accordingly, some portions of the barrel 20 where the bond is not perfect is acceptable.

The forging process advantageously produces a light-weight and strong composite barrel having a bond between the two components that is superior in strength and durability to conventional methods of bonding different barrel components together as described above. These conventional methods do not structurally reform and reshape the component materials, but merely attempt to mechanically couple the barrel components together without altering their structure or shape. And in contrast to conventional composite barrel constructions using two threaded components that are essentially just screwed together, a composite barrel made by the foregoing forging process fuses the materials together which cannot be unscrewed or loosened, either manually or by vibration induced through discharging the firearm. Accordingly, the composite barrel of the present invention will not loosen and rattle over time. In addition, the hammer forging process advantageously produces the bond in a single operation using existing firearm factory equipment which already is used for working and producing other firearm components, such as all-steel barrels. Accordingly, production economies and efficiencies may be realized.

As an example, a typical weight reduction which may be achieved for a composite rifle barrel formed according to principles of the present invention in contrast to an all steel barrel of the same dimensions is in the range of about 7-8 pounds using an aluminum outer sleeve and 4-5 pounds using a titanium outer sleeve.

It should be noted that the type of materials and wall thicknesses used for the tube and sleeve, together with the tube-sleeve assembly 32, 34 feed rate through the hammer forge and RPM of the mandrel determines the forging force and resulting strength of the bond between the tube and sleeve. Based on experience with using hammer forge machines in producing conventional one-piece steel barrels, it is well within the abilities of one skilled in the art to optimize the foregoing parameters for producing a satisfactory bond between the tube and sleeve. It will also be appreciated that the initial pre-forged OD and wall thicknesses of the tube and sleeve necessary to produce a final forged composite barrel of the proper dimensions will vary based on the caliber of the firearm barrel intended to be produced.

The foregoing forging process may be used to fabricate composite long or short barrels for either rifles or pistols, respectively. In addition, it is contemplated that more than two materials may be bonded together to produce composite barrels, or other articles unrelated to firearms, using the forging process and principles of the present invention. For example, it may be desirable to construct an article having a strong, hard inner tube and lighter-weight sleeve as already described herein, but with a strong hard outermost shell on top of the sleeve for better impact resistance. In one such possible embodiment, this construction may include a steel inner tube and thin steel outermost shell, with an aluminum or titanium sleeve disposed therebetween. Accordingly, there are numerous variations of multiple material composite articles that are contemplated and may be produced according to the principles of the present invention described herein.

According to another aspect of the invention, the foregoing process may used to create composite parts for numerous applications unrelated to firearms where it is desirable to have the stronger and more dense material on the outside of the composite tubular structure for various reasons, such as impact resistance to exteriorly applied loads. In essence, this construction is the reverse of the exemplary firearm barrel construction described above. In one possible embodiment, therefore, such a composite structure may include a lower density inner tube made of aluminum, titanium, or alloys thereof, and a higher density outer sleeve made of steel. These components may be configured the same way as inner tube 32 and outer sleeve 34 described above, but merely reversing the lighter and heavier materials in position for the inner tube and outer sleeve. The components of the composite part may then be bonded together via hammer forging in a manner similar to that described above for tube-sleeve assembly 32, 34. Such constructions may be advantageously used in the aviation and aerospace industries where strong, yet light-weight tubular constructions are beneficial.

Although the hammer forging process is described herein and preferred, it will be appreciated that other forging techniques and machines are contemplated and may be used to create composite barrels according to principles of the present invention described herein.

While the foregoing description and drawings represent the preferred embodiments of the present invention, it will be understood that various additions, modifications and substitutions may be made therein without departing from the spirit and scope of the present invention as defined in the accompanying claims. In particular, one skilled in the art will appreciate that the invention may be used with many modifications of structure, arrangement, proportions, sizes, materials, and components used in the practice of the invention, which are particularly adapted to specific needs and operating requirements, without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A method of forming a forged composite firearm barrel using a hammer forging machine, comprising:

providing an inner tube having a first density and a wall thickness, the inner tube defining a bore having a diameter larger than the wall thickness of the inner tube;

providing an outer sleeve having a second density less than the first density;

inserting the inner tube into the outer tube defining a tube-sleeve assembly having first and second ends, the inner tube having an exterior surface including recessed areas disposed proximate to the first and second ends;

loading the tube-sleeve assembly into a hammer forging machine comprising a plurality of diametrically-opposed reciprocating hammers having radially oscillating inward and outward motion;

supporting the tube-sleeve assembly on a mandrel inserted through the inner tube;

simultaneously rotating and axially advancing the tube-sleeve assembly through the reciprocating hammers from the first end to the second end;

repetitiously striking forcibly an outer surface of the sleeve in a radially inward direction with the reciprocating hammers;

displacing a portion of the outer sleeve to engage the inner tube progressively in sequence from the first end to the second end as the tube-sleeve assembly passes through the reciprocating hammers, wherein the sleeve is fixedly bonded to the inner tube from end to end including in the recessed areas at the first and second ends of the tube-sleeve assembly to form a composite firearm barrel that resists any relative longitudinal axial movement between and the sleeve and tube when bonded together.

2. The method of claim 1, wherein the displacing step includes displacing at least a portion of the outer sleeve to engage at least some of the recessed areas.

3. The method of claim 2, wherein the recessed areas are shaped as helical grooves formed between successive convolutions of flat-topped ridges having a width larger than a width of the grooves.

4. The method of claim 1, further comprising the outer sleeve having a first configuration prior to the impacting step and a second configuration after the impacting step, the second configuration different than the first configuration.

5. The method of claim 4, wherein the second configuration of the outer sleeve includes raised areas formed on an outer surface of the outer sleeve that are received in recessed areas of the inner tube.

6. The method of claim 1, wherein the outer sleeve is made of a material selected from the group consisting of aluminum, aluminum-alloy, titanium, and titanium-alloy.

7. The method of claim 1, wherein the inner tube is made of steel.

8. A method of forming a forged composite firearm barrel using a hammer forging machine, comprising:

providing a tube-sleeve assembly having first and second ends, and including an outer sleeve and an inner tube disposed therein, the sleeve having inner and outer surfaces, the inner tube having an exterior surface and a wall thickness, the inner tube defining a bore having a diameter larger than the wall thickness of the inner tube, the inner tube including a plurality of recessed areas disposed on the exterior surface proximate to the first and second ends;

supporting the tube-sleeve assembly on a mandrel having a spiral rifling groove pattern formed in raised relief thereon;

loading the tube-sleeve assembly into a hammer forging machine comprising a plurality of diametrically-opposed reciprocating hammers having radially oscillating inward and outward motion;

simultaneously rotating and axially advancing the tube-sleeve assembly through the reciprocating hammers from the first end to the second end;

striking the outer surface of the sleeve in a radially inward direction with the reciprocating hammers;

forming a spiral rifling groove in the bore of the inner tube;

embedding at least a portion of the exterior surface of the inner tube into the inner surface of the sleeve progressively in sequence from the first end to the second end as the tube-sleeve assembly passes through the reciprocating hammers to bond the sleeve to the inner tube;

wherein the sleeve is fixedly bonded to the inner tube from end to end including in the recessed areas at the first and second ends of the tube-sleeve assembly to form a composite firearm barrel that resists any relative longitudinal axial movement between the sleeve and tube when bonded together.

9. The method of claim 8, wherein the inner surface of the sleeve is embedded in at least some of the recessed areas during the embedding step.

10. The method of claim 9, wherein the recessed areas are shaped as helical grooves formed between successive convolutions of flat-topped ridges having a width greater than a width of the grooves.

11. The method of claim 8, wherein the tube is made of a material having a first density and the sleeve is made of a material having a second density less than the first density.

12. The method of claim 8, wherein the inner tube is made of steel and the outer sleeve is made of a material selected from the group consisting of aluminum, aluminum-alloy, titanium, and titanium-alloy.

13. The method of claim 8, further comprising the outer sleeve having a first configuration prior to the striking step and a second configuration after the striking step, the second configuration different than the first configuration.

14. The method of claim 13, wherein the outer sleeve has raised areas received in recessed areas of the inner tube in the second configuration.

15. The method of claim 8, wherein the outer sleeve has a first diameter prior to the striking step and a second diameter after to the striking step, the second diameter smaller than the first diameter.

16. The method of claim 8, wherein the outer sleeve has a first length prior to the striking step and a second length after to the striking step, the second length being longer than the first length.

17. The method of claim 8, wherein the barrel is a rifle barrel.

18. A method of forming a forged composite article using a hammer forging machine, comprising:

providing a tube-sleeve assembly having first and second ends, and including an outer sleeve and an inner tube disposed therein, the sleeve having inner and outer surfaces, the inner tube having an exterior surface and a wall thickness, the inner tube defining a bore having a diameter larger than the wall thickness of the inner tube, the inner tube including recessed areas disposed on the exterior surface proximate to the first and second ends;

supporting the tube-sleeve assembly on a mandrel;

loading the tube-sleeve assembly into a hammer forging machine comprising a plurality of diametrically-opposed reciprocating hammers having radially oscillating inward and outward motion;

simultaneously rotating and axially advancing the tube-sleeve assembly through the reciprocating hammers from the first end to the second end; and repetitiously striking the tube-sleeve assembly to bond the outer sleeve to the inner tube progressively in sequence from the first end to the second end as the tube-sleeve assembly passes through the reciprocating hammers;

wherein the sleeve is fixedly bonded to the inner tube from end to end including in the recessed areas at the first and second ends of the tube-sleeve assembly to form a composite firearm barrel that resists any relative longitudinal axial movement between the sleeve and tube when bonded together.

19. The method of claim 18, wherein the forging step includes hammering the outer surface of the sleeve in a generally radially inward direction.

20. The method of claim 18, wherein the striking step includes embedding the sleeve into at least a portion of the recessed areas.

21. The method of claim 18, wherein the tube is made of metal having a first density and the sleeve is made of metal having a second density, the first density being different than the second density.

22. The method of claim 21, wherein the second density is less than the first density.

23. The method of claim 18, wherein the tube is made of steel or steel-alloy and the sleeve is made of a metal selected from the group consisting of aluminum, aluminum-alloy, titanium, and titanium-alloy.

24. The method of claim 18, wherein the composite article is a firearm barrel.

25. The method of claim 18, wherein the forging step includes embedding portions of the outer sleeve into helical grooves on the inner tube that are formed between successive convolutions of flat-topped ridges having a width greater than a width of the grooves.

26. The method of claim 18, wherein the inner tube extends completely through the outer sleeve from one end of the sleeve to an opposite end.

27. The method of claim 18, further comprising a step of forming a chamber configured to hold an ammunition cartridge in the inner tube of the tube-sleeve assembly after the forging step.

28. A method of forging a composite firearm barrel using a hammer forging machine, comprising:

providing a tube-sleeve barrel assembly having first and second ends, and including an outer sleeve and an inner tube disposed therein and longitudinally extending completely through the sleeve from a muzzle end to an opposite chamber end, the sleeve having inner and outer surfaces, the inner tube having an exterior surface and a wall thickness, the inner tube defining a bore having a diameter larger than the wall thickness of the inner tube;

loading the tube-sleeve assembly into a hammer forging machine comprising two pairs of diametrically-opposed reciprocating hammers having radially oscillating inward and outward motion;

supporting the tube-sleeve assembly on a mandrel having a spiral rifling pattern formed in raised relief thereon;

simultaneously rotating and axially advancing the tube-sleeve through the pairs of diametrically-opposed reciprocating hammers;

repetitiously striking the outer surface of the sleeve with the hammers in a radially inwards direction with sufficient force to deform the outer sleeve;

forming the spiral rifling groove into the bore of the inner tube simultaneously with the striking step progressively in sequence from the first end to the second end as the tube-sleeve assembly passes through the reciprocating hammers;

embedding simultaneously with the striking step at least a portion of the inner surface of the outer sleeve into helical grooves formed on the exterior surface of inner tube between successive convolutions of flat-topped ridges having a width greater than a width of the grooves, the helical grooves extending continuously from the first end to the second end of the tube-sleeve assembly, wherein the embedding occurs progressively in sequence from the first end to the second end as the tube-sleeve assembly passes through the reciprocating hammers;

wherein the sleeve is fixedly bonded to the inner tube from end to end including in the grooves at the first and second ends of the tube-sleeve assembly to form a composite firearm barrel that resists any relative longitudinal axial movement between the sleeve and tube when bonded together.

29. The method of claim 28, wherein the inner tube has a density greater than a density of the outer sleeve.

30. The method of claim 29, wherein the sleeve is made of a metal selected from the group consisting of aluminum, aluminum-alloy, titanium, and titanium-alloy.

31. The method of claim 28, further comprising a step of forming a chamber configured to hold an ammunition cartridge in the inner tube of the tube-sleeve assembly after the embedding step.

32. A method of forging a composite article using a hammer forging machine, comprising:

providing a tube-sleeve assembly having first and second ends, and including an outer sleeve and an inner tube disposed therein, the sleeve having inner and outer surfaces, the inner tube having an exterior surface and a wall thickness, the inner tube defining a bore having a diameter larger than the wall thickness of the inner tube, the inner tube including a plurality of recessed areas disposed on the exterior surface proximate to the first and second ends;

supporting the tube-sleeve assembly on a mandrel;

loading the tube-sleeve assembly into a hammer forging machine comprising two pairs of diametrically-opposed reciprocating hammers having radially oscillating inward and outward motion;

simultaneously rotating and axially advancing the tube-sleeve assembly through the reciprocating hammers from the first end to the second end;

repetitiously hammering the outer surface of the tube-sleeve assembly in a radially inward direction with the reciprocating hammers; and embedding a portion of the outer sleeve into the recesses formed on the inner tube progressively in sequence from the first end to the second end as the tube-sleeve assembly passes through the reciprocating hammers to bond the sleeve to the tube;

wherein the sleeve is fixedly bonded to the inner tube from end to end including in the recessed areas at the first and second ends of tube-sleeve assembly to form a composite firearm barrel that resists any relative longitudinal axial movement between the sleeve and tube when bonded together.

33. The method of claim 32, wherein the recesses are shaped as helical grooves formed between successive convolutions of flat-topped ridges having a width greater than a width of the grooves to resist crushing by the hammering step.

34. The method of claim 33, wherein the mandrel includes a spiral rifling pattern formed in raised relief thereon, and the hammering step includes transferring the rifling pattern to an inner surface of the tube adjacent the bore.

35. The method of claim 32, wherein the sleeve is made of a metal selected from the group consisting of aluminum, aluminum-alloy, titanium, and titanium-alloy.

36. The method of claim 32, wherein the inner tube has a density greater than a density of the outer sleeve.

37. The method of claim 32, further comprising a step of forming a chamber configured to hold an ammunition cartridge in the inner tube of the tube-sleeve assembly after the embedding step.

* * * * *

UNITED STATES PATENT AND TRADEMARK OFFICE

CERTIFICATE OF CORRECTION

PATENT NO. : 7,934,332 B2
APPLICATION NO. : 11/360197
DATED : May 3, 2011
INVENTOR(S) : Vernon R. Briggs It is certified that error appears in the above-identified patent and that said Letters Patent is hereby corrected as shown below:

Column 13, line 9, delete:

"between and the sleeve and tube when bonded together."

Column 13, line 9, replace:

"between the sleeve and tube when bonded together."

Signed and Sealed this
Twenty-third Day of October, 2012

David J. Kappos

David J. Kappos
*Director of the United States Patent and Trademark Office*